US009048047B2

(12) United States Patent
Huang et al.

(10) Patent No.: US 9,048,047 B2
(45) Date of Patent: Jun. 2, 2015

(54) MICRO-REED SWITCH WITH HIGH CURRENT CARRYING CAPACITY AND MANUFACTURING METHOD THEREOF

(71) Applicant: NATIONAL TSING HUA UNIVERSITY, Hsinchu (TW)

(72) Inventors: Yu-Che Huang, Hsinchu (TW); Fu-Ming Hsu, Hsinchu (TW); Wei-Leun Fang, Hsinchu (TW)

(73) Assignee: NATIONAL TSING HUA UNIVERSITY, Hsinchu (TW)

( * ) Notice: Subject to any disclaimer, the term of this patent is extended or adjusted under 35 U.S.C. 154(b) by 0 days.

(21) Appl. No.: 14/056,114

(22) Filed: Oct. 17, 2013

(65) Prior Publication Data

US 2014/0035706 A1 Feb. 6, 2014

(30) Foreign Application Priority Data

Mar. 12, 2013 (TW) ..... 102108748 A

(51) Int. Cl.

| | |
|---|---|
| ***H01H 36/00*** | (2006.01) |
| ***H01H 11/00*** | (2006.01) |
| *H01H 1/00* | (2006.01) |
| *H01H 11/02* | (2006.01) |
| *H01H 29/00* | (2006.01) |

(52) U.S. Cl.

CPC ..... *H01H 36/00* (2013.01); *H01H 11/005* (2013.01); *Y10T 29/49105* (2015.01); *H01H 1/0036* (2013.01); *H01H 11/02* (2013.01); *H01H 36/0006* (2013.01); *H01H 2029/008* (2013.01)

(58) Field of Classification Search

CPC ... H01H 1/0036; H01H 11/005; H01H 11/02; H01H 36/0006; H01H 2029/008; Y10T 29/49105

USPC ..... 335/151–154; 29/622

See application file for complete search history.

(56) References Cited

U.S. PATENT DOCUMENTS 3,921,108 A * 11/1975 O'Connor ..... 335/153
4,164,720 A * 8/1979 Bollen ..... 335/47

OTHER PUBLICATIONS

Min Tang et al, "A MEMS Microreed Switch With One Reed Embedded in the Silicon Substrate", Journal of Microelectromechanical Systems, vol. 20, No. 6, pp. 1336-1344, Dec. 2011.

* cited by examiner

*Primary Examiner* — Ramon Barrera
(74) *Attorney, Agent, or Firm* — Rabin & Berdo, P.C.

(57) ABSTRACT

A micro-reed switch includes a first magnetic reed and a second magnetic reed. The first magnetic reed includes a first metal electrode and a first non-wettable area. The first metal electrode includes a liquid metal. The second magnetic reed includes a second metal electrode and a second non-wettable area. The first magnetic reed and second magnetic reed is parallel to each other and a gap is defined there between. When a magnetic field is available, the liquid metal and the second metal electrode are engaged with one another by a magnetic force of the magnet.

20 Claims, 6 Drawing Sheets

MICRO-REED SWITCH WITH HIGH CURRENT CARRYING CAPACITY AND MANUFACTURING METHOD THEREOF

CROSS-REFERENCE TO RELATED APPLICATION

This application claims priority of application No. 102108748, filed on Mar. 12, 2013 in the Taiwan Intellectual Property Office.

FIELD OF THE INVENTION

The invention relates to a micro-reed switch and a manufacturing method thereof, and more particularly to a micro-reed switch with high current carrying capacity and manufacturing method thereof.

BACKGROUND OF THE INVENTION

The conventional reed switch includes a glass tube having two low magnetic hysteresis ferrous metal reeds. The metal reeds are consisted of 80% nickel and 20% iron, whose end portions are separated by a small gap when the switch is open, whose contact points are plated with a hard metal layer and are usually made of rhodium and ruthenium. The hard metal layer increases service life of the reed switch. The glass tube is filled with nitrogen or equal noble gas usually. The glass tube is vacuumed for increasing performance of switch voltage.

The metal reeds can be actuated to make a contact by using an external magnetic field and the loop of the reed switch is normally in close state. When the external magnetic field is removed, a spring returns the reed back to its original position and the loop of the reed switch is once again an open circuit.

To compare with the conventional reed switch, the micro reed switch is deposited with precious metal (rhodium, rubidium or ruthenium), whose structure has high melting and thermostability material, which can receive high current to increase device character. For example, Min Tang, Yong Hean Lee, Rakesh Kumar, Member, IEEE, Ravi Shankar, Olivier Le Néel and Giuseppe Noviello disclose a MEMS microreed switch with one reed embedded in Journal of Microelectromechanical Systems, vol. 20, No. 6, December 2011, which consists of two $Ni_{80}Fe_{20}$ magnetic plates as microreeds.

However, the micro reed switch is fabricated by semiconductor fabrication or micro-electromechanical fabrication, which has high manufacture cost, and current carrying capacity is only 0.1 milliamperes that does not accord to the requirement (at least 50 milliamperes) of the conventional reed switch. Even all engineers know the fault; they seem to have no acceptable and easy solution to solve the problem.

SUMMARY OF THE INVENTION

One objective of the invention is to provide a micro-reed switch with high current carrying capacity.

In order to accomplish the aforementioned objective, a micro-reed switch with high current carrying capacity is provided for sensing a magnetic field. The micro-reed switch comprises:

a first magnetic reed and comprises:

a first metal electrode comprises a liquid metal; and a first non-wettable area comprises a first conductor connected to the liquid metal; and a second magnetic reed separated from the first magnetic reed and being paralleled to the first magnetic reed, the second magnetic reed comprises:

a second metal electrode corresponding to the first metal electrode; and a second non-wettable area having a second conductor connected to the second metal electrode;

It is to be noted that when the magnetic field exists, the liquid metal electrode and the second metal electrode engage with one another via a magnetic force from the magnet field. When the magnetic field is not available, the liquid metal electrode and the second metal electrode are separated from one another via a resilience force generated by the first magnetic reed and the second magnetic reed.

Another objective of the present invention is to provide a manufacturing method of a micro-reed switch with high current carrying capacity.

In order to accomplish the aforementioned objective, a manufacturing method of a micro-reed switch of the preferred embodiment of the present invention comprises the steps of:

forming a first magnetic reed and a second magnetic reed;

depositing a first metal electrode and a first conductor on the first magnetic reed and a second metal electrode and a second conductor on the second magnetic reed;

defining a first non-wettable area on the first magnetic reed and a second non-wettable area on the second magnetic reed;

hanging the first magnetic reed and the second magnetic reed to define a distance between the first magnetic reed and the second magnetic reed;

dispensing a liquid metal to the first metal electrode; and sealing the first magnetic reed and the second magnetic reed to form a micro-reed switch.

DETAILED DESCRIPTION OF THE INVENTION

Figure 1:
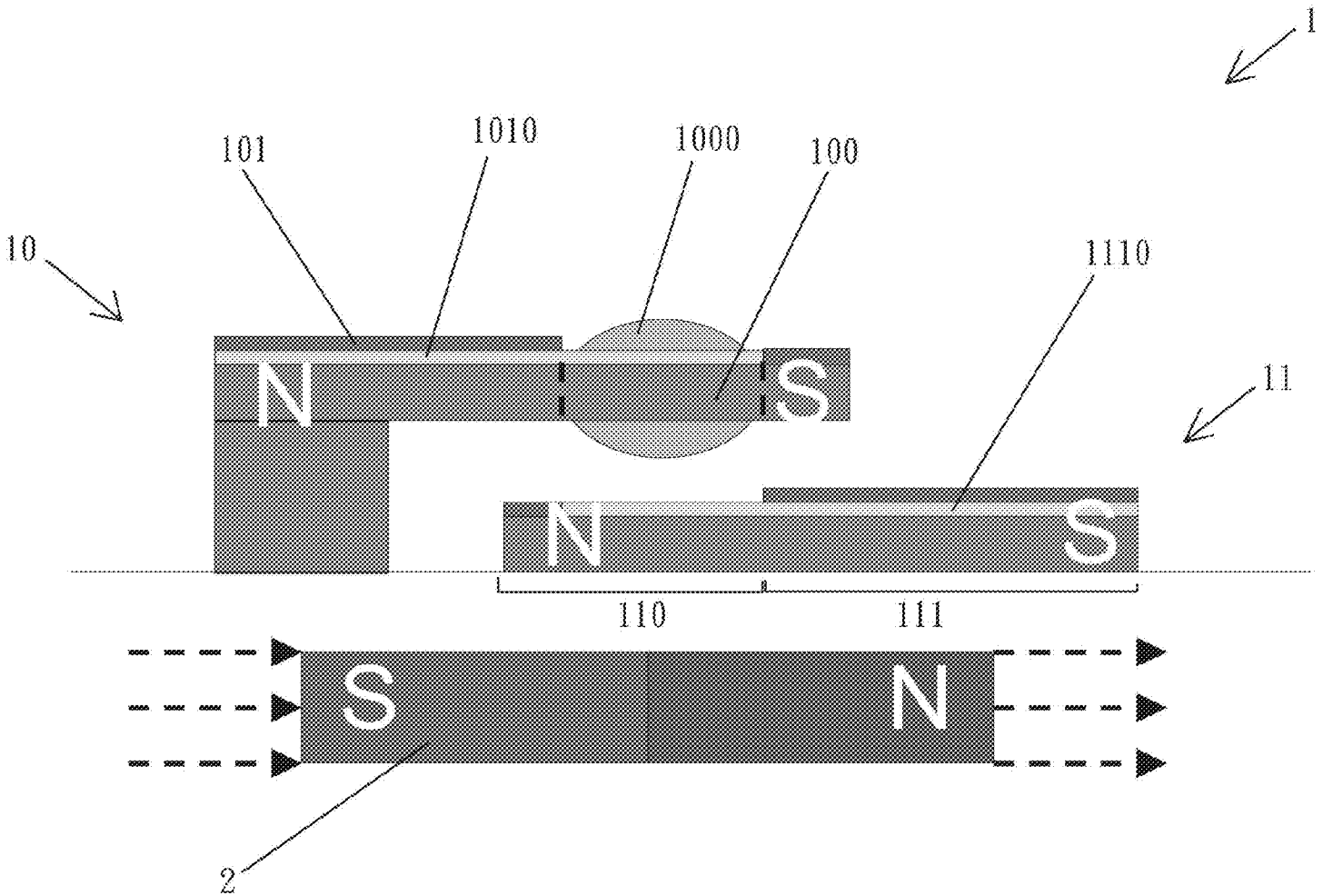
FIG. 1 is a perspective view showing the micro-reed switch with high current carrying capacity of the preferred embodiment of the present invention.
Figure 2:
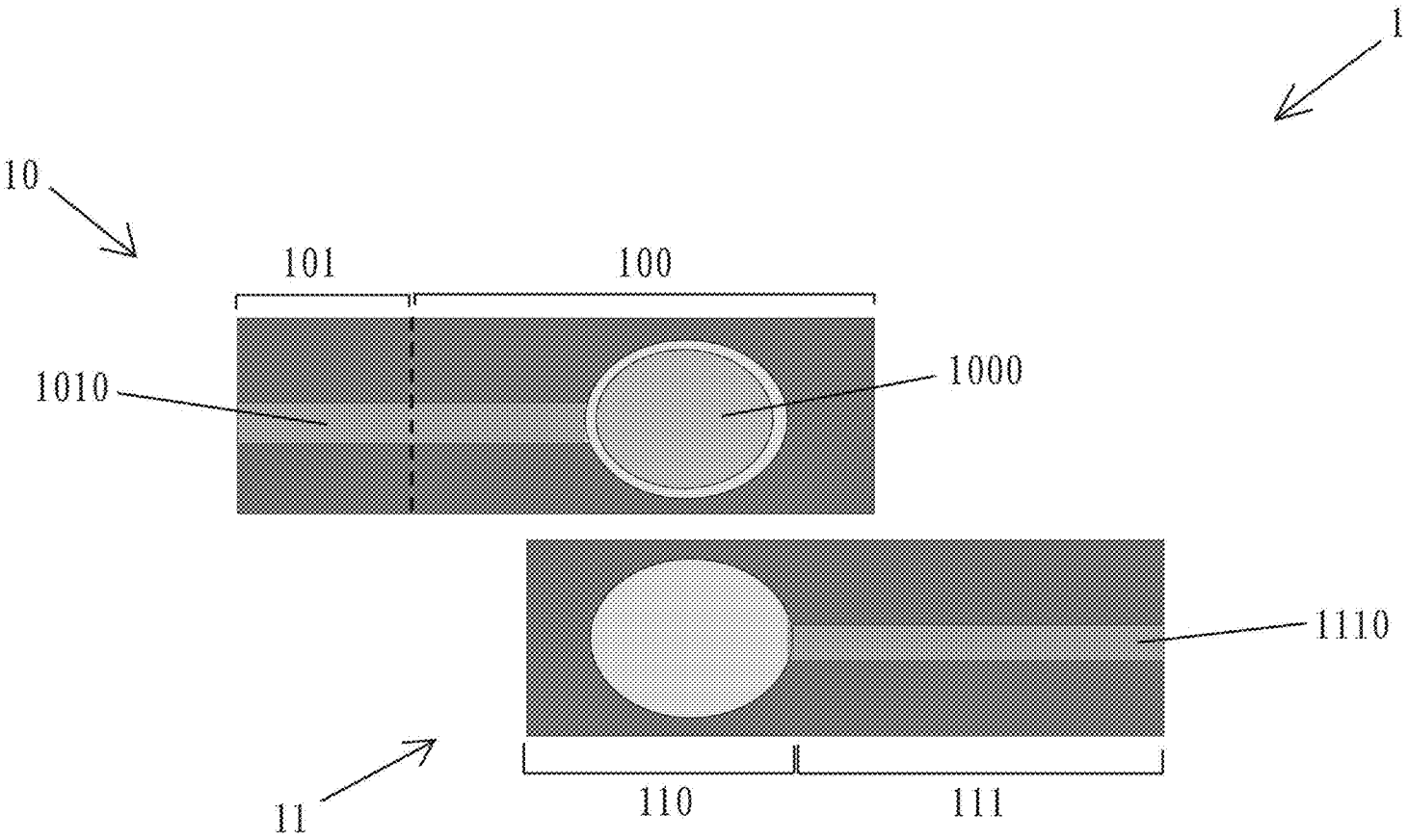
FIG. 2 is a top view showing the micro-reed switch of the preferred embodiment of the present invention.
Figure 3A:
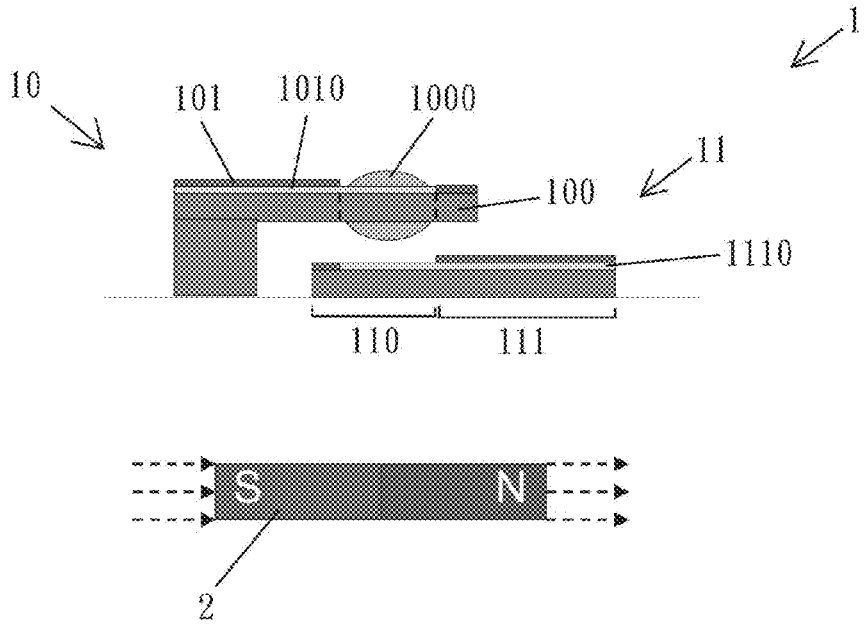
FIG. 3A is a perspective view showing the magnetic field being away from the micro-reed switch.
Figure 3B:
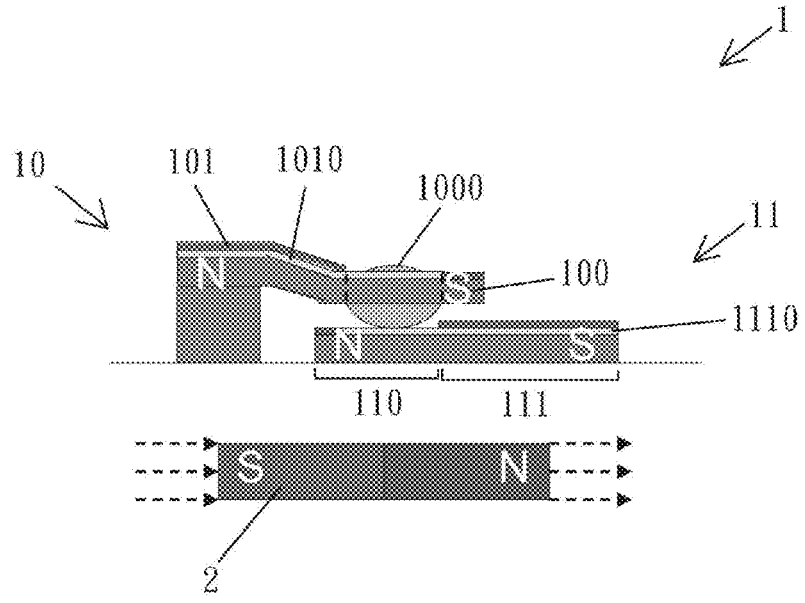
FIG. 3B is a perspective view showing the magnetic field approaching the micro-reed switch.

In order to describe details of the preferred embodiment of the present invention, description of the structure, and the application as well as the steps are made with reference to the accompanying drawings. It is learned that after the description, any variation, modification or the like to the structure and the steps of the embodiments of the preferred embodiment of the present invention is easily made available to any person skilled in the art. Thus, the following description is only for illustrative purpose only and does not, in any way, try to limit the scope of the present invention.

With reference to FIGS. 1 to 3B of the preferred embodiment of the present invention, a micro-reed switch constructed in accordance with the present invention is able to determine whether the magnetic field 2 exists and comprises a first magnetic reed 10 and a second magnetic reed 11.

The first magnetic reed 10 is magnetic and comprises a first metal electrode 100 and a first non-wettable area 101. The first metal electrode 100 comprises a liquid metal 1000. The first non-wettable area 101 comprises a first conductor 1010. The first conductor 1010 is connected to the liquid metal 1000.

The second magnetic reed 11 is magnetic and is parallel to the first reed 10. A gap is defined between the first magnetic reed 10 and the second magnetic reed 11. The second magnetic reed 11 comprises a second metal electrode 110 and a second non-wettable area 111. The second metal electrode 110 corresponds to the first metal electrode 100. The second non-wettable area 111 comprises a second conductor 1110. The second conductor 1110 is connected to the second metal electrode 110.

When the magnetic field 2 exists, the liquid metal 1000 and the second metal electrode 110 are engaged with each other by a magnetic force of the magnet field 2. When the magnetic field 2 does not exists, the liquid metal 1000 and the second metal electrode 110 are separated from each other by a resilience force of the first magnetic reed 10 and the second magnetic reed 11.

In a preferred embodiment of the present invention, the magnetic field 2 is generated by such as a magnet, an electromagnetic coil or a magnetic substance, which is located under the second magnetic reed 11 without engagement with and parallel to the second magnetic reed 11. The liquid metal 1000 is gallium-indium-tin alloy, mercury or sodium-potassium alloy. The first magnetic reed 10 and the second magnetic reed 11 are made of nickel-iron alloy.

Figure 4:
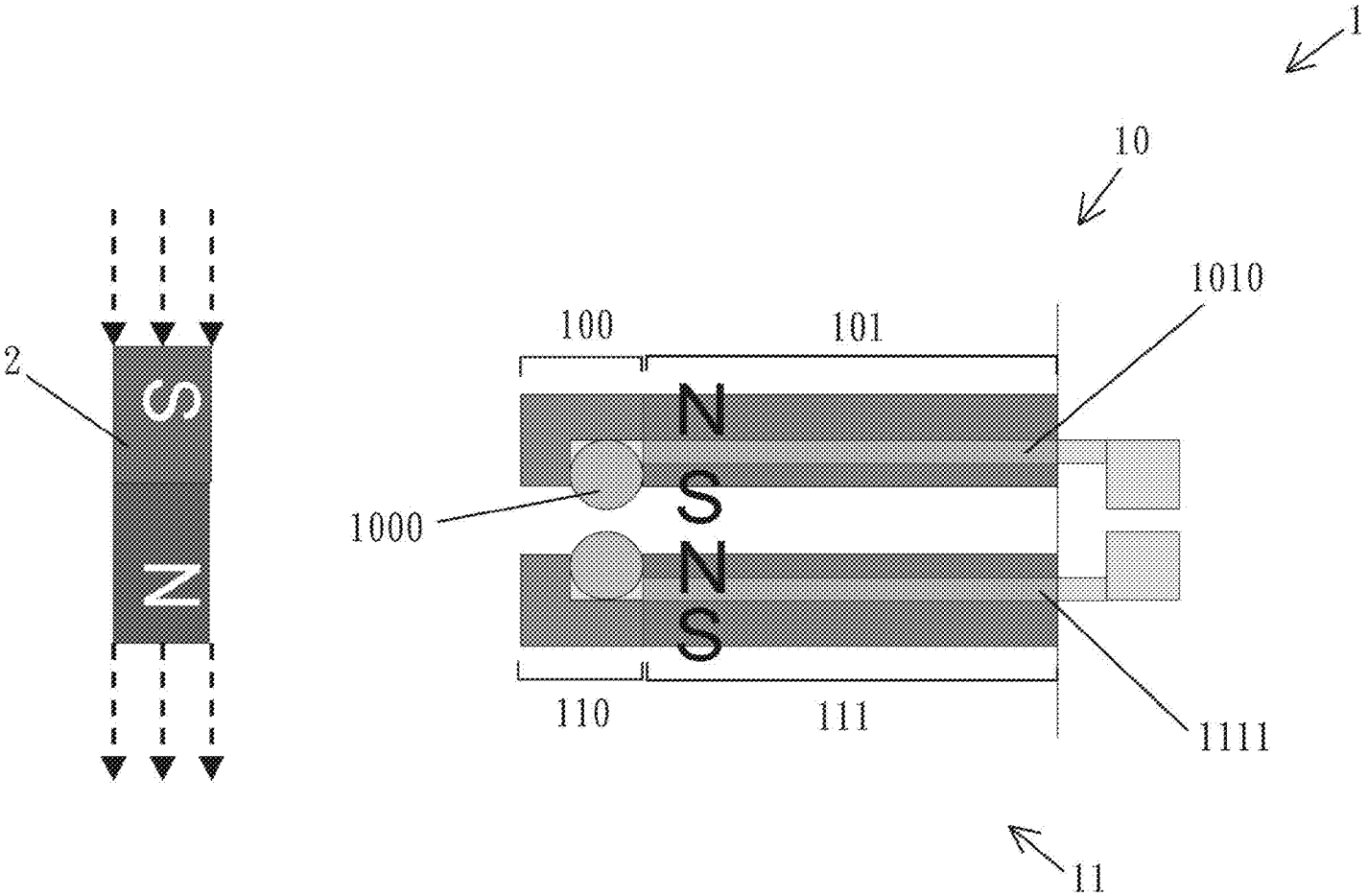
FIG. 4 is a perspective view showing another embodiment of the micro-reed switch of the present invention.
Figure 5A:
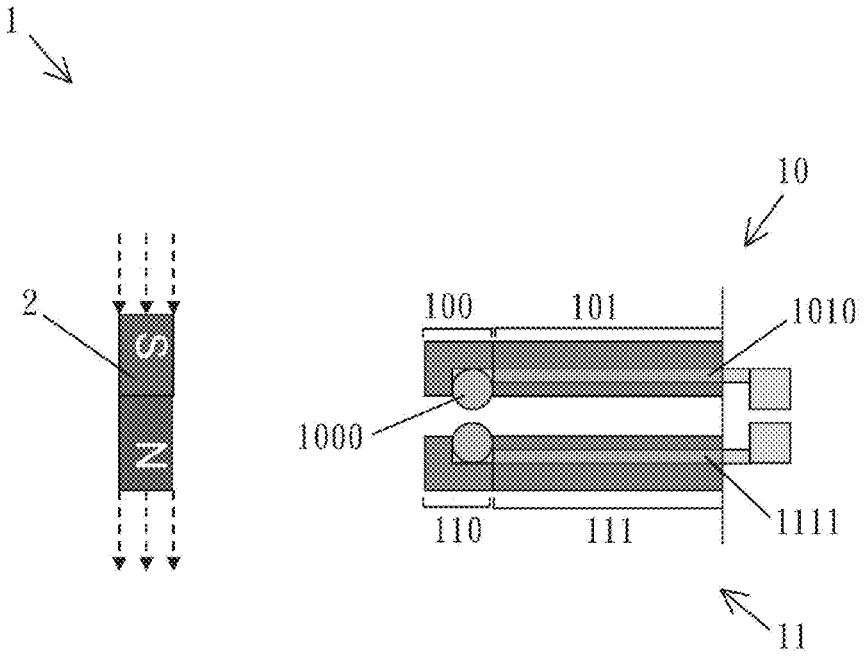
FIG. 5A is a perspective view showing another embodiment of the magnetic field away from the micro-reed switch.
Figure 5B:
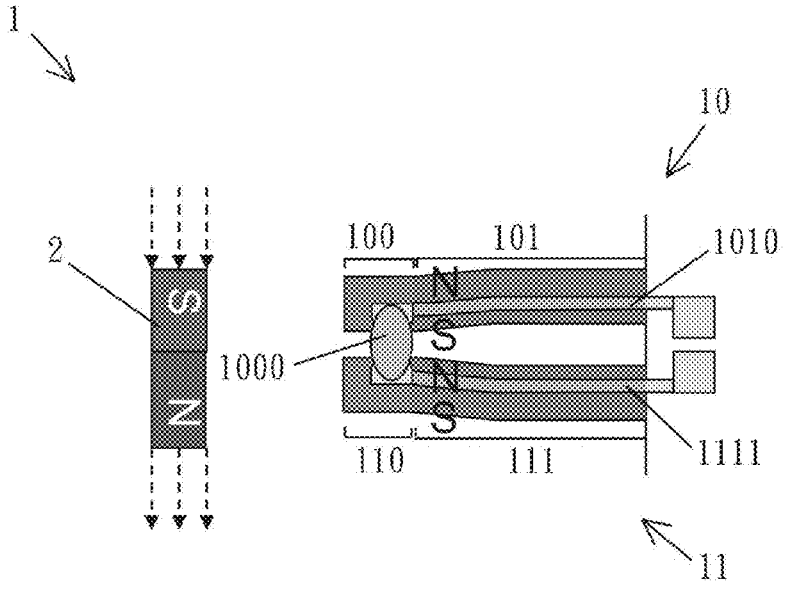
FIG. 5B is a perspective view showing another embodiment of the magnetic field approaching the micro-reed switch of the present invention.

With reference to FIGS. 4 to 5B of another preferred embodiment of the present invention, the magnetic field 2 is located on the same surface with the first metal electrode 100 and the second metal electrode 110 without contact with the first metal electrode 100 and the second metal electrode 110. The orientation of the magnetic field 2 is perpendicular to the first reed 10 and the second magnetic reed 11.

Figure 6:
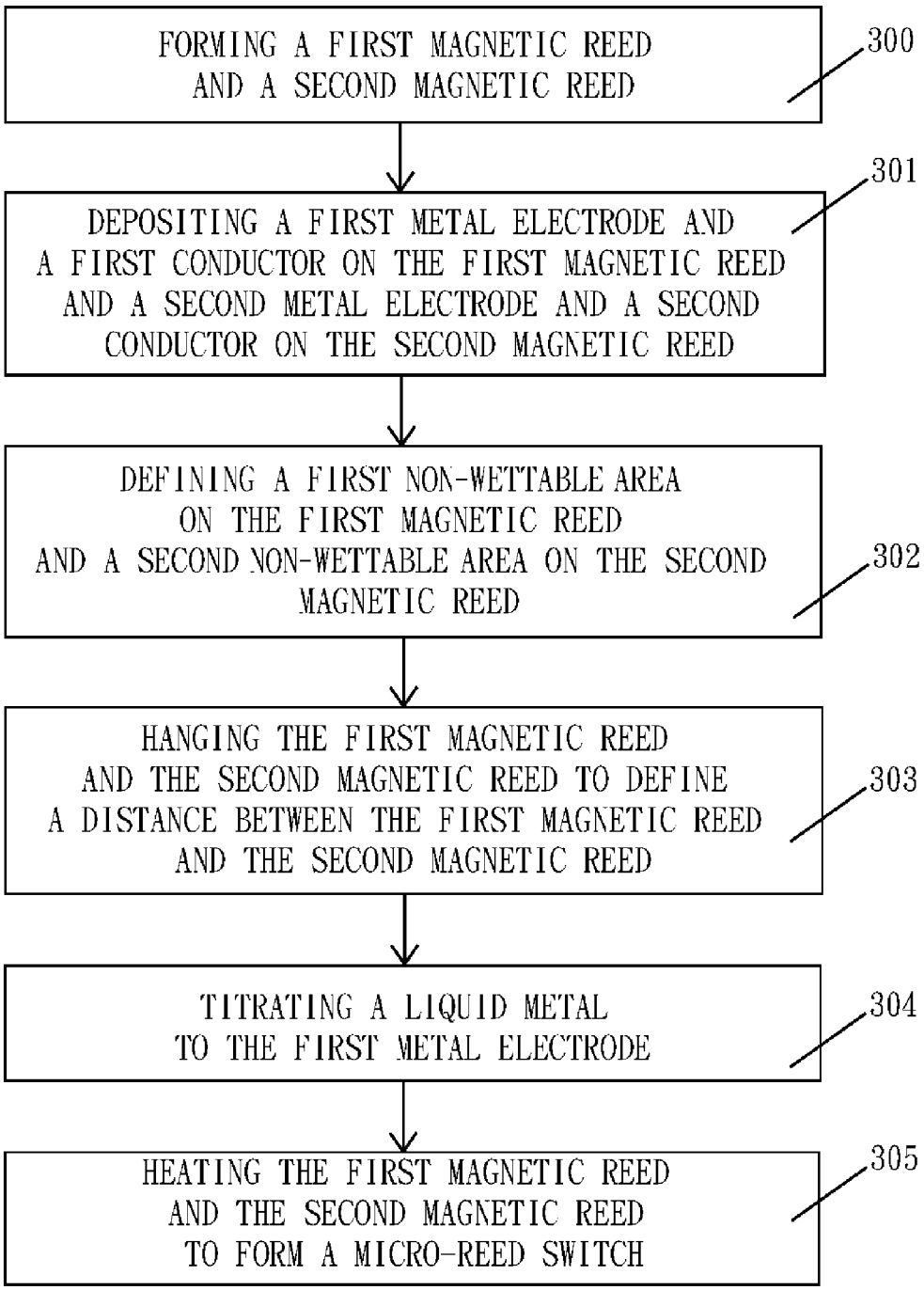
FIG. 6 is a flow chart showing the manufacturing method of a micro-reed switch of the preferred embodiment of the present invention.

With reference to FIGS. 1 and 6 of the preferred embodiment of the present invention, a manufacturing method of a micro-reed switch with high current carrying capacity 3 comprises the steps of:

300: forming a first magnetic reed and a second magnetic reed;

301: depositing a first metal electrode and a first conductor on the first magnetic reed and a second metal electrode and a second conductor on the second magnetic reed;

302: defining a first non-wettable area on the first magnetic reed and a second non-wettable area on the second magnetic reed;

303: hanging the first magnetic reed and the second magnetic reed to define a distance between the first magnetic reed and the second magnetic reed;

304: dispensing a liquid metal to the first metal electrode; and

305: sealing the first magnetic reed and the second magnetic reed to form a micro-reed switch.

In a preferred embodiment of the present invention, the step 300 is completed by depositing ferromagnetic material through a precision electroplating technology. The step 301 is completed by physical vapor deposition. The step 302 is completed by polymer depositing system, photolithography patterning and oxygen plasma etching. The step 303 is completed by using micro-electromechanical process surface micromachining technology, sacrificial-layer etching or bulk micromachining technology to etch silicon or glass substrate. The liquid metal 1000 is gallium-indium-tin alloy, mercury or sodium-potassium alloy. The first magnetic reed 10 and the second magnetic reed 11 are made of nickel-iron alloy.

The micro-reed switch 1 and the manufacturing method 3 of the present invention can lower contact resistance of magnetic sensing structure, whose current carrying capacity is at least 100 milliamperes that increases performance and yield of the micro-reed switch 1, broadens applicability and lowers cost.

While the invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

What is claimed is:

1. A micro-reed switch comprising:

a first magnetic reed comprising:

a first metal electrode having a liquid metal and being disposed at a leading edge of the first magnetic reed; and a first non-wettable area having a first conductor connected to the liquid metal and being disposed at a trailing edge of the first magnetic reed; and a second magnetic reed parallel to the first magnetic reed and separated from the first magnetic reed, the second magnetic reed comprising:

a second metal electrode corresponding to the first metal electrode and being disposed at a leading edge of the second magnetic reed; and a second non-wettable area being disposed at a trailing edge of the second magnetic reed and comprising a second conductor connected to the second metal electrode such that when there is a magnetic field, the liquid metal and the second metal electrode engage with one another by a magnetic force of the magnet field and when the magnetic field is not available, the liquid metal and the second metal electrode are separated from each other by a resilience of the first magnetic reed and the second magnetic reed.

2. The micro-reed switch as claimed in claim 1, wherein the magnetic field is generated by a magnet, an electromagnetic coil or a magnetic substance, the magnetic field is located under the second reed without engagement with and parallel to the second magnetic reed.

3. The micro-reed switch as claimed in claim 1, wherein the magnetic field is generated by a magnet, an electromagnetic coil or a magnetic substance, the magnetic field is located on the same surface with the first metal electrode and the second metal electrode without contact with the first metal electrode and the second metal electrode, and the orientation of the magnetic field is perpendicular to the first magnetic reed and the second magnetic reed.

4. The micro-reed switch as claimed in claim 1, wherein the liquid metal is gallium-indium-tin alloy, mercury or sodium-potassium alloy.

5. The micro-reed switch as claimed in claim 2, wherein the liquid metal is gallium-indium-tin alloy, mercury or sodium-potassium alloy.

6. The micro-reed switch as claimed in claim 3, wherein the liquid metal is gallium-indium-tin alloy, mercury or sodium-potassium alloy.

7. The micro-reed switch as claimed in claim 1, wherein the first magnetic reed and the second magnetic reed are made of nickel-iron alloy.

8. The micro-reed switch as claimed in claim 2, wherein the first magnetic reed and the second magnetic reed are made of nickel-iron alloy.

9. The micro-reed switch as claimed in claim 3, wherein the first magnetic reed and the second magnetic reed are made of nickel-iron alloy.

10. A manufacturing method of a micro-reed switch with high current carrying capacity, the method comprising the steps of:

forming a first magnetic reed and a second magnetic reed;

depositing a first metal electrode and a first conductor on the first magnetic reed and a second metal electrode and a second conductor on the second magnetic reed;

defining a first non-wettable area on the first magnetic reed and a second non-wettable area on the second magnetic reed;

hanging the first magnetic reed and the second magnetic reed to define a distance between the first magnetic reed and the second magnetic reed;

dispensing a liquid metal to the first metal electrode; and sealing the first magnetic reed and the second magnetic reed to form a micro-reed switch.

11. The method as claimed in claim 10, wherein the forming step is completed by depositing ferromagnetic material through a precision electroplating technology, the depositing step is completed by physical vapor deposition.

12. The method as claimed in claim 10, wherein the defining step is completed by polymer depositing system, photolithography patterning and oxygen plasma etching, the hanging step is completed by using micro-electromechanical process surface micromachining technology, sacrificial-layer etching or bulk micromachining technology to etch silicon or glass substrate.

13. The method as claimed in claim 11, wherein the defining step is completed by polymer depositing system, photolithography patterning and oxygen plasma etching, the hanging step is completed by using micro-electromechanical process surface micromachining technology, sacrificial-layer etching or bulk micromachining technology to etch silicon or glass substrate.

14. The method as claimed in claim 10, wherein the liquid metal is gallium-indium-tin alloy, mercury or sodium-potassium alloy.

15. The method as claimed in claim 11, wherein the liquid metal is gallium-indium-tin alloy, mercury or sodium-potassium alloy.

16. The method as claimed in claim 12, wherein the liquid metal is gallium-indium-tin alloy, mercury or sodium-potassium alloy.

17. The method as claimed in claim 13, wherein the liquid metal is gallium-indium-tin alloy, mercury or sodium-potassium alloy.

18. The method as claimed in claim 10, wherein the first magnetic reed and the second magnetic reed are made of nickel-iron alloy.

19. The method as claimed in claim 11, wherein the first magnetic reed and the second magnetic reed are made of nickel-iron alloy.

20. The method as claimed in claim 12, wherein the first magnetic reed and the second magnetic reed are made of nickel-iron alloy.

* * * * *